United States Patent [19]

Nakata

[11] 4,075,506

[45] Feb. 21, 1978

[54] TIMING APPARATUS

[76] Inventor: Yohei Nakata, 22-2, Nakahara 2-chome, Isogo, Yokohama, Kanagawa, Japan

[21] Appl. No.: 662,513

[22] Filed: Mar. 1, 1976

[30] Foreign Application Priority Data

Mar. 5, 1975 Japan ..... 50-26717
Dec. 31, 1975 Japan ..... 50-158512

[51] Int. Cl.[2] ..... H01H 43/00

[52] U.S. Cl. ..... 307/117; 200/46; 307/141; 58/33; 250/227

[58] Field of Search ..... 200/46, 23, 24, 25, 200/26; 58/12, 14, 33; 307/117, 141, 141.4, 141.8; 235/201 FS, 201 R; 250/236, 570, 227, 231

[56] References Cited

U.S. PATENT DOCUMENTS 2,477,741 8/1949 Haberman ..... 200/46
3,525,094 8/1970 Leonard ..... 250/231 SE
3,576,407 4/1971 Stephens ..... 200/46

*Primary Examiner*—Robert K. Schaefer
*Assistant Examiner*—Morris Ginsburg

[57] ABSTRACT

A timing apparatus comprising a time plate equipped with light transmitting holes or brushes which are positioned, at points representative of times and arranged at equal intervals in at least one row. The light transmitting holes or brushes serve as logical connection elements indicating such times. At least two rotators are coaxially disposed inside the time plate in a rotatable manner and also have light transmitting holes or brushes respectively corresponding with the logical connection elements on the time plate. The relative speeds of rotation of the time plate and the rotators are predetermined in such a manner so that the position of each logical connection element on the time plate and the positions of the corresponding logical connection elements on the rotators come into alignment at a given time indicated by the elements, thereby effecting electrical or optical timing connection at a desired time.

10 Claims, 31 Drawing Figures

TIMING APPARATUS

BACKGROUND OF THE INVENTION

1. Field of the Invention

The present invention relates to an electrical or optical timing apparatus capable of serving as a timing connector or a timing indicator or a combination thereof.

2. Description of the Prior Art

Although a variety of timing devices have been proposed and used heretofore, there does not exist a low-cost device suited for driving radio or television sets. Of late, there are available replacements for the conventional receivers of a mechanical switching system especially with respect to the selection of a channel. Electronic tuner type radio and television sets employing a purely electrical switching system are commercially available. Using the electronic tuner has the features of requiring no power and achieving immediate selection of a desired channel. With regard to all electric apparatus including radio and television sets, it seems to be the general trend that such features of no power requirement and sequential operation gradually extend the kind and scope of applications in accordance with the progress of electronic circuits. It is also one of the recent trends that, a single timing device is used for driving many electric circuits or apparatus at desired times in an interrelated and programmed sequence; for example, in selective reception of multiple radio and television channels.

Among the conventional timing connectors capable of performing programmed driving operation, there are many types which are known including type that effects mechanical timing connection by the use of a cam, the type that causes electrical slide contact of segments by a rotating brush, the digital type employing a relay circuit, and the electronic type using a digital logic circuit. Each of the above devices have both merits and faults. Namely, the one utilizing a cam is superior with respect to the ease of attaining a simple mechanism and large driving power but has a fault in maintaining drive time accuracy during a long period. The one causing electrical slide contact has a fault in service life. The optical one has, in most cases, some difficulties with time accuracy and program change. The one with a relay becomes bulky in structure. And the electronic one with a digital logic circuit is expensive, though it may be nearly universal with high accuracy and a performance superior to any of other types. Thus, there has not yet appeared any convenient, low-cost device that is equipped with a timing plate capable of presetting and changing a complicated program and permitting ready confirmation of the setting state.

SUMMARY OF THE INVENTION

The principal object of the present invention resides in providing a low-cost timing device offering a high time accuracy and suited to drive apparatus of the aforementioned type trend.

Another object of the invention is to provide a timing device excellent in the points featuring compactness in structure and facility in setting, change and confirmation of program. Furthermore, the present invention provides a novel device capable of serving as a timing indicator which is different from any of the conventional products known heretofore. If the definition of timing indication is widened to "timing indication of each and every time" to substantially denote a clock, the present invention comes to provide a particular analog indication type clock that utilizes the shift of a light point, or the like. Thus, it is another feature of the present invention to be capable of providing a convenient timing device usable also as a timing indicator.

DETAILED DESCRIPTION OF THE PREFERRED EMBODIMENTS

Hereinafter exemplary embodiments of the present invention will be described.

Embodiment 1

Figure 1:
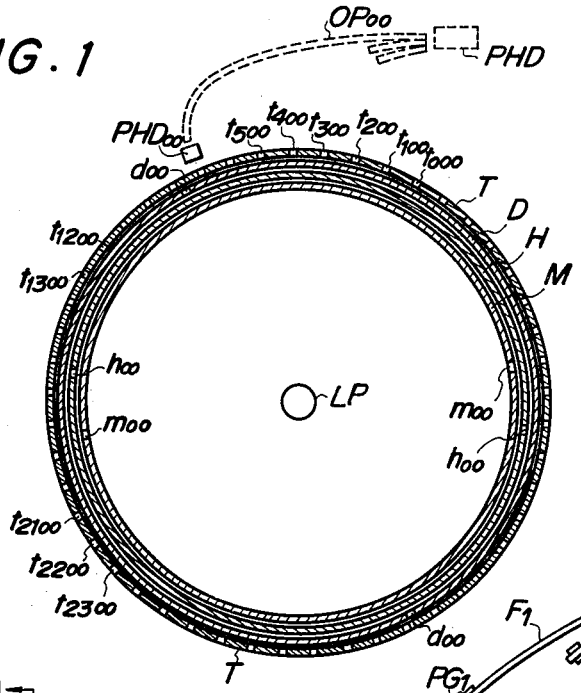
FIG. 1 is a sectional view of an optical timing indicator taken along the line AA of FIG. 2.
Figure 2:
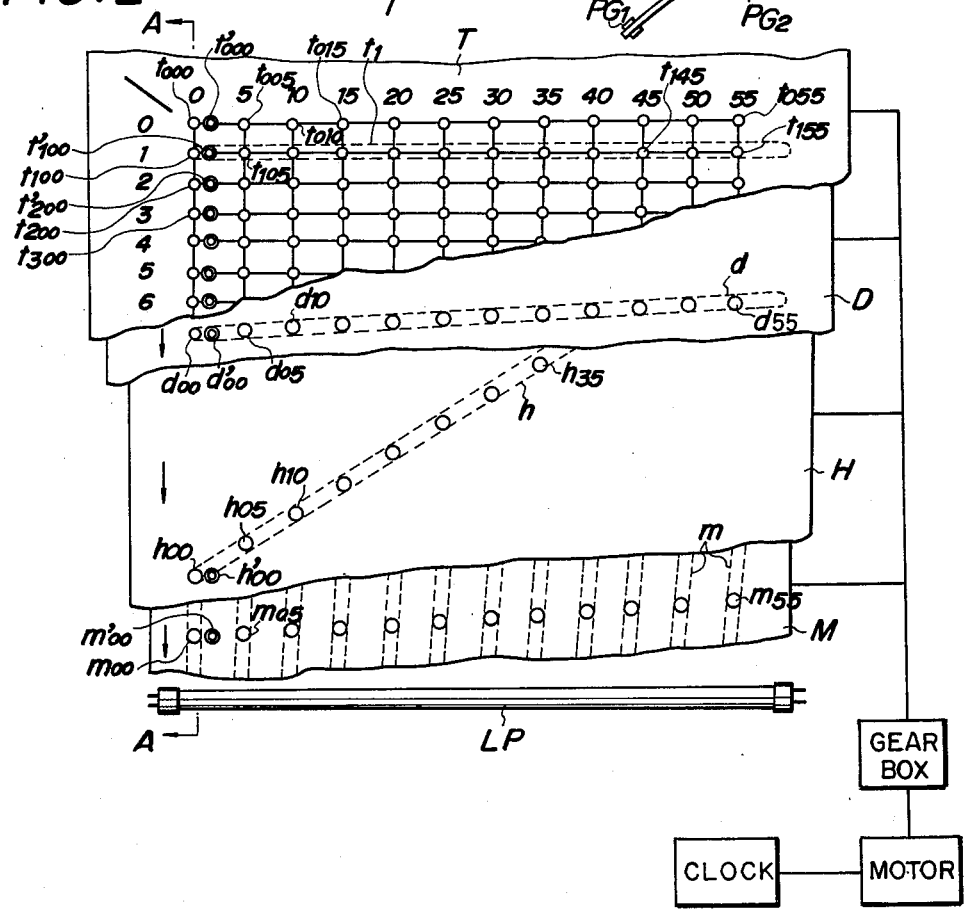
FIG. 2 is a partially developed plane view of an optical timing indicator.

FIGS. 1 and 2 respectively show a sectional view and a plane view of an optical timing indicator which is capable of serving also as a timing connector as will be mentioned hereafter, wherein the plane view of FIG. 2 shows the development of a cylinder, and the sectional view of FIG. 1 shows the section taken along the line A—A of FIG. 2. In the drawings, a cylindrical time plate labeled as T is composed of an opaque substance, where one day (24 hours) is coarsely divided at 1-hour intervals into hours (0 . . . . 23 hours) and plotted along the vertical axis (in the circumferential direction) while each hour is finely divided at 5-minute intervals into minutes (0 . . . 55 minutes) and plotted along the horizontal axis (in the axial direction), in such a manner that the individual times (0:00, 0:05 . . . 23:55) obtained by dividing one day at 5-minute intervals are arranged in the form of a lattice on a half surface of the cylinder. Time elements ***t*000, *t*005 . . . . *t*2355** representative of times 0:00, 0:05 . . . 23:55 are fixedly disposed at the individual lattice points. The time elements *t*000 and so forth consist of simple light transmitting holes formed on the time plate T. Inside the cylindrical time plate T, an opaque cylindrical slow rotator D coaxial with T rotates in the direction of the arrow at a low speed of one-half revolution per 24 hours. The slow rotator D has slow apertures *d*00, *d*05 . . . *d*55 for transmission of conduction of light (equivalent to each other in meaning) in such an array that each pair of apertures are formed at symmetrical positions with respect to the axis. And the individual slow apertures *d*00, *d*05 and so forth pass sequentially through the respective insides of the rows *t*000 . . . *t*2300, *t*005 . . . *t*2305 and so forth of the lattice point groups at the given times assigned to the individual lattice points providing a relatively long time width with the given times being at the center of the time widths. In the instance where the lattice point arrangement on the time plate T forms orthogonal coordinates as shown in FIG. 2, the slow apertures *d*00 and so forth on the slow rotator D are arranged with an inclination of a fixed angle with respect to the horizontal axis, as illustrated.

Inside the slow rotator D rotates an opaque cylindrical fast rotator H coaxial with D and T. Rotator H rotates in the direction of the arrow at a high speed of one-half revolution per hour + one-half revolution per 24 hours. The fast rotator H has fast apertures *h*00, *h*05 . . . *h*55 for transmission of light in such an array that each pair of apertures are formed at symmetrical positions with respect to the axis. The individual fast apertures *h*00, *h*05 and so forth pass sequentially through the respective insides of the vertical rows *t*000 . . . *t*2300, *t*005 . . . *t*2305 and so forth of the lattice point groups at the given times assigned to the individual lattice points and produces a relatively short time width with each of the given times being in the center of the time width. The fast apertures *h*00 and so forth on the fast rotator H are arranged with an inclination of a fixed angle to the arrangement of time elements *t*000 and so forth, as illustrated.

The angular difference between the inclination of slow aperture arrangement (*d*00 and so forth) and the inclination of fast aperture arrangement (*h*00 and so forth) results from the difference between the rotation speeds of the two rotators. Further inside the fast rotator H, rotates a very fast opaque cylindrical rotator M coaxial with T, D and H in the direction of the arrow at a very high speed of (one-half revolution per 5 minutes + one-half revolution per 24 hours). Light-transmitting very fast aperture *m*00, *m*05 . . . *m*55, are disposed on the very fast rotator M with each pair thereof formed symmetrically with respect to the axis in the same manner as above. The very fast apertures transmit light and pass sequentially through the respective insides of the vertical rows *t*000 . . . *t*2300, *t*005 . . . *t*2305 and so forth of the lattice point groups, as in the case of the slow and fast apertures, at the given times assigned to the individual lattice points, while taking a time width shorter than the other two with each of the given times being in center. The very fast apertures *m*00 and so forth are arranged also with an inclination on the very fast rotator M. Similarly to the foregoing case, this inclination is related to the rotation speed of the very fast rotator M. The time interval in the axially adjacent slow, fast and very fast apertures is 5 minutes, respectively, in the direction of rotation.

A lamp LP is provided on the common axis of the time plate T and the rotators D, H and M.

The actions of the individual apertures having the above configuration are as follows. Referring first to time element group *t*000, *t*100 . . . . *t*2300 of the 1st vertical row shown in FIG. 1, when slow aperture *d*00 is passing slowly through the inside of *t*000 at time 0:00, fast aperture *h*00 passes through the inside of *d*00 quickly, and very fast aperture *m*00 passes through the inside of *h*00 even more quickly, so that the light from lamp LP is transmitted via time element *t*000 to the outside at exactly 0:00 for several to 10-odd seconds. That is, time element *t*000 is illuminated to indicate the time. Next to *t*000, in the same manner, time element *t*100 is illuminated at time 1:00 by the cooperation of the three apertures *d*00, *h*00 and *m*00. Subsequently, time elements *t*200 . . . . *t*2300 are illuminated at times 2:00 . . . 23:00 respectively. Each of these time elements is not illuminated at any time other than that assigned to the corresponding lattice point.

It is apparent that the timing indication accomplished by the cooperation of a time element and three apertures in the above-described action is like a logical product.

In the step following the 2nd vertical row of FIG. 2, the operation of the timing indication is exactly the same, in which time elements *t*005, *t*105 and so forth of the 2nd row are illuminated with a lag of 5 minutes from time elements *t*000, *t*100 and so forth of the 1st row, respectively. With regard to the 3rd, 4th . . . 12th vertical rows as well, the same occurs in sequence with a 5-minute lag individually. Thus, the device shown in FIGS. 1 and 2 can be regarded as a timing indicator for each and every time of 24 hours at 5-minute intervals. In this indicator, the very fast aperture has the effect to enhance a time accuracy by narrowing the time width of illumination of each time element. When a higher time accuracy is desired, apertures rotating at a greater speed may be added to the above structure to achieve the purpose. In most cases, however, it is more practical to render the device simpler and less expensive by eliminating the very fast apertures and rotator therefrom, with concomitant reduction of the time accuracy and increase of the indication time width. Therefore, it may be said that such a simplified structure is the prototype of the present invention.

For the purpose of avoiding erroneous indication, the aperture width measured in the direction of rotation is determined to be within the time interval of coarse division in the case of the slow aperture, or within the time interval of fine division in the case of the fast aperture, in consideration of the dimensions of light transmitting holes for time elements and the interrelation among the widths of apertures. In the instance where the prototype device equipped merely with slow and fast apertures is employed for timing indication, a useful indicator may be obtained by widening each aperture intentionally to illuminate a plurality of time elements simultaneously. In this case, indication will be shifted with simultaneous illumination of a plurality of time elements such as ($t000 + t005 + t010$), ($t005 + t010$), ($t005 + t010 + t015$), ($t010 + t015$) and so on. Thus, each aperture width according to the present invention is, in principle, within the time interval of coarse or fine division but is not necessarily limited thereto.

Embodiment 2

In the timing indicator of Embodiment 1, each time indication during 24 hours is performed at a 5-minute interval. It is obviously possible to obtain, using the same structure, an indicator of longer cycle and smaller interval for example, 1-week cycle and 1-minute intervals by determining the coarse and fine divisions of the time to suitable values. Furthermore, continuous time indication can also be attained by modifying the structure in the following manner. In FIG. 2: (1) Time elements are connected. For example, horizontally arrayed time elements *t*100, *t*105 . . . *t*155 are replaced with a single long light-transmitting slit *t*1 (shown by dotted lines) of a slender shape that connects them all, and the time elements of the entire rows are replaced with slits; (2) The entire slow apertures *d*00, *d*05 . . . *d*55 of slow rotator D are replaced with long light-transmitting slits *d* (shown by dotted lines) of a slender shape that connects them all; (3) The entire fast apertures *h*00, *h*05 . . . *h*55 of fast rotator H are replaced with long light-transmitting slits *h* (shown by dotted lines) of a slender shape that connects them all; and (4) The entire very fast apertures *m*00, *m*05 . . . *m*55 of very fast rotator M are replaced with spiral light-transmitting slits *m* of a slender shape that connects them all.

Figure 4:
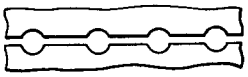
FIG. 4 is a partial plane view of a time element used to attain continuous time indication from the device of FIG. 2.

In the device having the above structure, timing indication is performed by a light point moving continuously from left to right at least within the coarsely divided time, thereby providing a clock based on the new indication system. If the slit *t*1 on the time plate is formed into such a shape as shown in FIG. 4, the illumination of the light point increases at 5-minute intervals to enrich the expression of timing indication.

Embodiment 3

Figure 3:
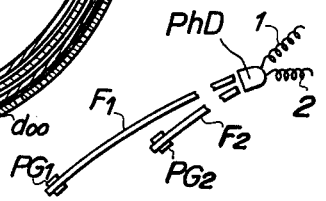
FIG. 3 is a side view of a time element used when the indicator of FIG. 2 is employed as a part of a timing connector.

The timing indicator mentioned above is usable directly as a part of a timing connector. This purpose is accomplished by selectively inserting optical fibers F1 and F2, which are connected to a light-receiving photodiode PhD as shown in FIG. 3, into a desired time element out of *t*000 . . . *t*2355 through the use of plugs PG1 and PG2 of rubber or the like attached to the ends of F1 and F2. In this way, electrical timing connection is achieved between the two terminals 1 and 2 of photodiode PhD.

The number of independent loads to be driven at present times can be increased as desired by increasing the number of photodiodes, and the frequency of driving one load can be increased as desired by increasing the number of optical fibers connected to one photodiode.

In the device of Embodiment 1, it is impossible to drive two loads simultaneously even by inserting two optical fibers into one time element. However, such simultaneous drive can be effected by forming the time plate into a double structure through the additional provision of time elements *t'*000, *t'*100 and so forth (shown by double circles) in parallel with time elements *t*000, *t*100 and so forth, and further providing, in conformity thereto, slow apertures *d'*00 and so forth (shown by double circles) in parallel with slow apertures *d*00 and so forth, fast apertures *h'*00 and so forth (shown by double circles) in parallel with fast apertures *h*00 and so forth, and very fast apertures *m'*00 and so forth in parallel with very fast apertures *m*00 and so forth. Similarly, simultaneous drive of three or more loads is achievable by forming the time plate and rotators into a triple or multiplex structure.

In the timing connector employing photodiodes, the term "time element" is given to the optical fibers F1 and F2 to be inserted selectively into the light transmitting holes *t*00 and so forth, rather than to the light transmitting holes.

This embodiment is equipped with a combined function for both timing indication and timing connection.

Embodiment 4

In the foregoing embodiments, timing connection is attained by the use of a logical product obtained optically via light transmitting holes and apertures. Similar timing connection is also achievable on the basis of the following logical product obtained through mechanical time elements and rotary brushes.

Figure 5:
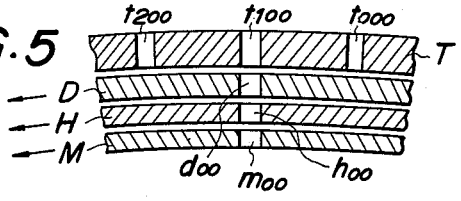
FIG. 5 is an enlarged partial view of FIG. 1, illustrating the state of coincidence of light transmitting holes.
Figure 6:
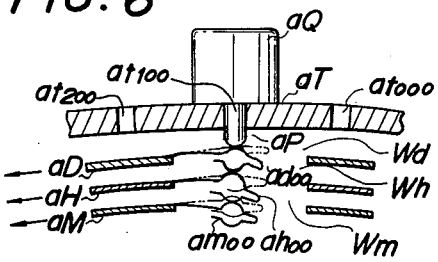
FIG. 6 is an enlarged partial view of a mechanical timing connector, corresponding to FIG. 5.
Figure 7:
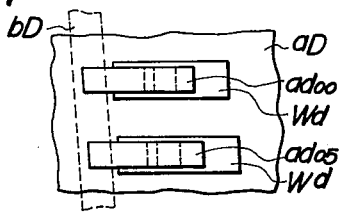
FIG. 7 is an enlarged plane view of the slow brush shown in FIG. 6.
Figure 8:
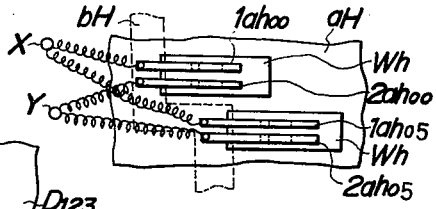
FIG. 8 is an enlarged plane view of the fast brush shown in FIG. 6.

FIG. 5 illustrates the state where transmission of light is received as a logical product by way of time element *t*00 at exactly 1:00 in the device of FIG. 1. A new embodiment plotted in conformity thereto is shown in FIGS. 6, 7 and 8. In FIG. 6, a plug labeled as aQ is inserted into a plug hole at100 selected in accordance with a desired time out of plug holes at000 so forth corresponding to light transmitting holes*t*000 and so forth of FIG. 5. The plug aQ has a nonconductive protrusion aP which protrudes inwardly. A nonconductive slow rotator aD, corresponding to, D holds. in its windows Wd, nonconductive slow brushes *ad*00 and so forth corresponding to *d*00 and so forth. A nonconductive fast rotator aH corresponding to H, holds in its windows Wh, conductive fast brushes *ah*00 and so forth assorted corresponding to fast apertures *h*00 and so forth. These fast brushes are divided into 1 *ah*00 and 2 *ah*00 as shown in the plane view of FIG. 8. A nonconductive very fast rotator aM corresponding to M holds in its windows Wm conductive very fast brushes *am*00 corresponding to *m*00 and so forth.

The positional relation among the arrangements of time elements, rotators and brushes in FIG. 6 is left unchanged, as observed in the plane view, in comparison with the positional relation among the arrangements of the corresponding components shown in FIGS. 1 and 2, and the rotation speed of each rotator is also left unchanged from in Embodiment 1.

FIG. 7 is a partial plane view illustrating how the slow rotator aD holds slow brushes *ad*00 and so forth.

Although unshown in the drawing, the very fast rotator aM holds very fast brushes *am*00 and so forth in the same manner. FIG. 8 illustrates how the fast rotator aH holds fast brushes 1*ah*00 and so forth and also 2*ah*00 and so forth. The brushes 1*ah*00 and so forth are grouped electrically at a terminal X, while the brushes 2*ah*00 and so forth are grouped alike at a terminal Y respectively on the fast rotator aH. The terminals X and Y are led from the rotator to external fixed terminals through a slide contact or other means and are connected to an external load, power source and ground to form a drive circuit (not shown). In the above-mentioned structure, timing connection is effected by the following cooperation of time elements and brushes performed on the basis of a logical product.

In FIG. 6, if the time element aQ is not inserted and accordingly its portion aP is not protruding inwardly, then the brushes are maintained in such states and positions as shown by dotted lines and are moved without mutual contact. However, when the plug aQ is inserted as illustrated, its protrusion aP presses the slow brush *ad*00 which is passing through the inside of aP, thereby causing flexure. The same action occurs sequentially in the order of slow brush *ad*00, fast brushes 1*ah*00 and 2*ah*00, and very fast brush *am*00, so that the former causes flexure in the latter. Consequently, conductive fast brushes 1*ah*00 and 2*ah*00 are short-circuited by conductive very fast brush *am*00 for a short time at 1:00 assigned to plug hole *at*100, thereby effecting timing connection between the terminals X and Y. Such timing connection takes place at the time assigned to every plug hole in which the time element aQ is selectively inserted.

Although the fast brushes and very fast brushes only are made conductive in the above description, it is obvious that similar timing connection is achievable between the terminals X and Y also in the case of removing the very fast brushes and, instead, rendering the slow brushes conductive.

Furthermore, in addition to the above example where timing connection is obtained in the fast brush itself (which is divided between 1ah00 and 2*ah*00), such timing connection is also obtainable in the slow brush itself as well. This can be accomplished by the following means: (1) With conductive slow brushes disposed as in FIG. 8, conductive fast brushes are arranged in the structure of FIG. 7 and there are no very fast brushes; (2) With conductive slow and fast brushes disposed as in FIG. 8 respectively, two slow brushes held in one window Wd are connected to two fast brushes 1*ah*00 and 2*ah*00 individually and then are short-circuited by a conductive very fast brush. In the above instance, it is also possible to form another configuration, in which the fast brush *ah*00 is removed from the nonconductive cylindrical fast rotator aH with window Wh alone being left, and when two slow brushes *ad*00 are pressed by aP to protrude inward from the window Wh, they are short-circuited directly by very fast brush *am*00. In this case, window Wh can be regarded as "negative fast brush" disposed on the fast rotator aH. Therefore, it follows that the cooperation based on a logical product is performed between the time element and brushes including such a negative brush; (3) Timing connection is achievable also in the plug aQ itself. For this purpose, plug protrusion aP may be composed of two conductors insulated from each other (not shown) by the same means as (2), and they may be short-circuited at a preset time through the cooperation based on a logical product of the three components, that is, the conductive slow brush, the fast brush of FIG. 8 and the conductive very fast brush of FIG. 7. Electrical connection can be led out easily from protrusion aP by joining a leadwire to plug aQ or by using time plate aT instead of the leadwire; and (4) Timing connection is achievable also between protrusion and brush, that is, between conductive protrusion aP or slow brush *ad*00 and fast brush *ah*00 or very fast brush *am*00, or between fast brush *ah*00 and very fast brush *am*00, and an external load can be driven by leading out such connection.

Noting the fact that the rotators aD, aH and aM in this embodiment function only to hold brushes, the shape of each rotator need not be cylindrical at all. Bent strips bD and bH shown by dotted lines in FIGS. 7 and 8 are in the simplest possible shape to hold brushes, and yet they are completely capable of serving as replacements of *a*D and *a*H. If composed of a conductor, such a strip (for example, bD) can combine the function of the leadwire as well for electrical connection. Moreover, very fast brush *am*00 of FIG. 6 need not be rendered flexible. Since flexure is caused on fast brush *ah*00, both the very fast brush and the very fast rotator may be replaced with strips such as bD or mere wires. Furthermore, a device of the same function can be obtained even by changing the mutual arrangements of slow, fast and very fast brushes with respect to inner and outer positions.

Embodiment 5

The timing devices of the foregoing embodiment can be combined to form a composite device by the use of single or plural rotators in common. The multiplex structure mentioned in Embodiment 3 and FIG. 2 is an exemplary mode of combination, and there are also the following modes.

Figure 9:
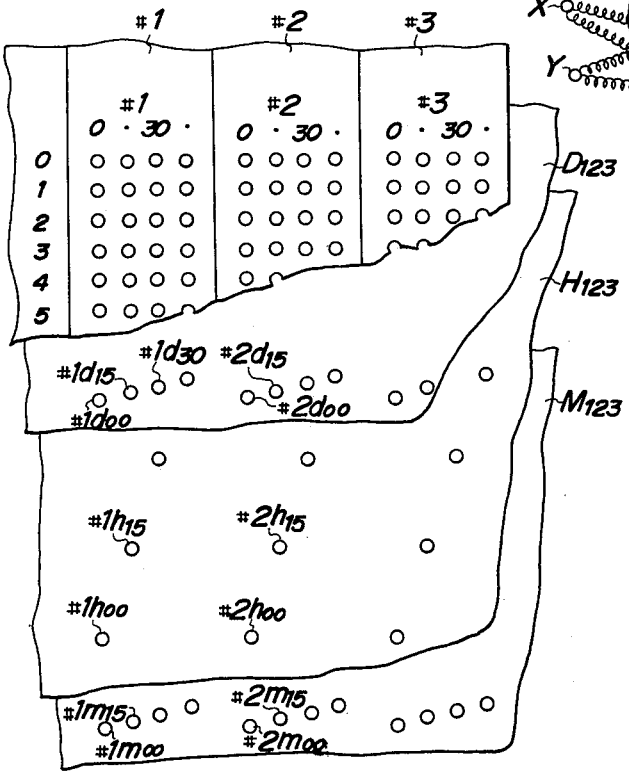
FIG. 9 is a partially developed plane view of a composite timing connector.
Figure 12:
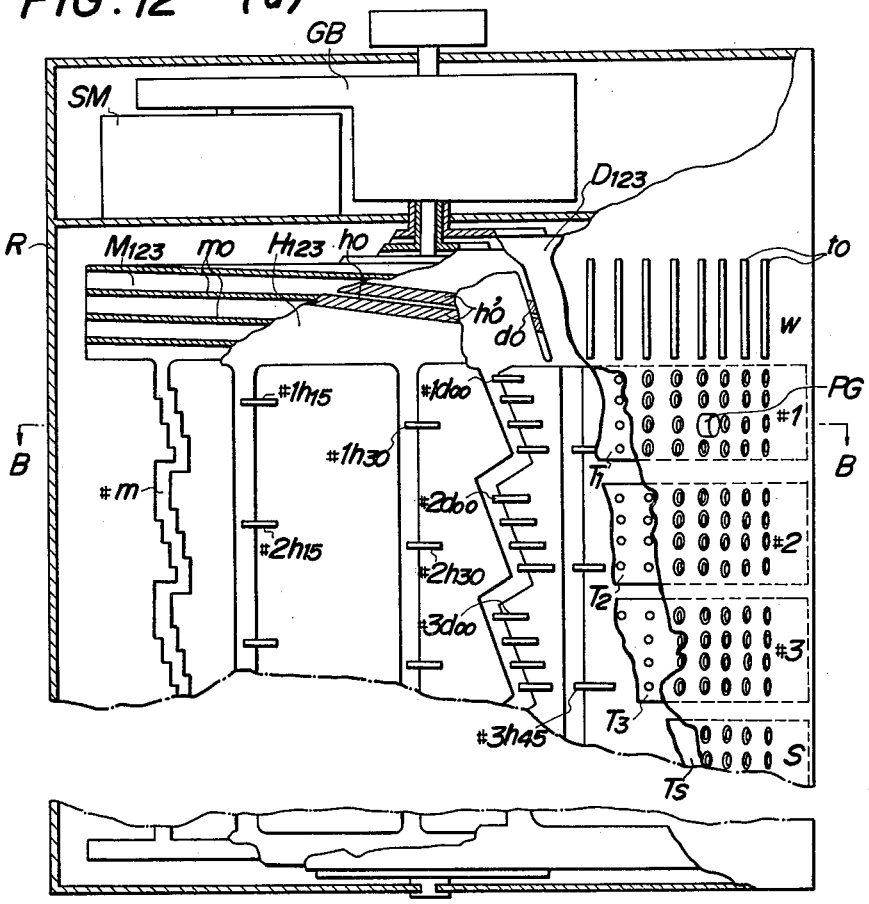
FIGS. 12 (*a*) and 12 (*b*) show a composite timing connector for use in a television set or the like, wherein FIG. 12 (*a*) is a partially sectional plane view, and FIG. 12 (*b*) is a sectional side view of a portion thereof.
Figure 12:
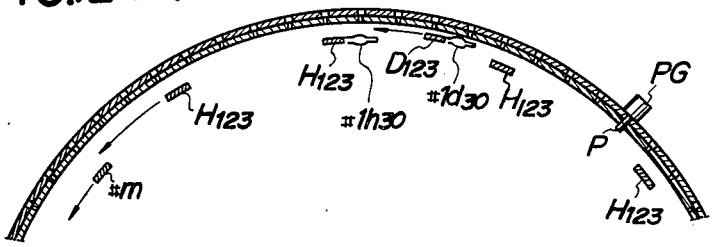

FIGS. 9 and 12 illustrate such a composite device, in which W, #1, #2, #3 and S are, originally, independent 24-hour-cycle 15-minute-interval timing devices respectively, and D123, H123 and M123 are slow, fast and very fast rotators used in common in the individual devices. The rotators respectively hold slow apertures or brushes #1d00 . . . , #2d00 . . . . . , fast apertures or brushes #1h15, #2h15 . . . , and very fast apertures or brushes #1m00, #1m15 . . . , #2m00, #2m15 . . . . or #m .

The composite device of FIG. 12 consists of a timing indicator W (clock) with a time plate covering one-third of the entire cylindrical surface and a timing connector #1 of 24-hour cycle and 15-minute interval. Accordingly, the rotation speeds of common rotators D123, H123, M123 and the number of aperture or brush groups held on the rotators take the values corresponding thereto.

An insulator case R is used in common, and its front surface is engraved with graduations to serve also as an ornamental face of the time plate of the timing device. Conductive time plates labeled as T1, T2, T3 . . . , Ts are insulated from one another and function also as leadwires for timing connections as will be described afterward. The device further comprises a synchronous motor SM; a gear box GB; light transmitting slits ***t*0, *d*0, *h*0** similar to *t*1, *d*, *h* of FIG. 2; yellow fluorescent paint ***h*0' applied to both sides of *h*0 on fast rotator H123; red fluorescent paint *m*0 applied linearly on rotator M123 so as to substitute for m and lamp LP of FIG. 2**; and plug PG such as banana chip having a conductive protrusion P. This composite device operates in the following manner. Time plates T1, T2 and so forth are initially connected to channel-selecting contact plates which are capable of selecting desired channels upon the touch of a finger. These are commercially available and are used on the electronic tuner of a television set. Therefore, at the time assigned to the plug hole where a plug PG serving as a time element is selectively inserted, timing connection is effected according to a logical product obtained through very fast brush #*m* × fast brush × slow brush × protrusion P. Since P is electrically in contact with the time plate, labeled as T1 in the drawing, and the conductive very fast brush #m is capacitively coupled with an a-c power source, or ground, by way of the conductive rotating shafts, the gear box GB and the synchronous motor SM, the channel connected to T1 is selected by the leakage hum, or ground. It is to be noted that D123 and H123 are nonconductive, while each brush, M123 and #m are conductive.

In case multiple plugs PG are inserted into plug holes of the composite device of FIG. 12 preset for desired channels and times, the tuning proceeds with the lapse of time in conformity to the preset program. To attain economical reception, it is desired that the time plate TS be connected to a device for switching off the television set and also that T1 and so forth are connected to a device for switching on the television set upon selection of each desired channel. Such devices can be designed with ease by those skilled in the art.

The advantages in combining a plurality of timing devices within an embodiment of common time plates or rotators, are summarized as follows: (1) Time plates or rotators and a rotatory drive mechanism are usable in common to simplify the structure; (2) A composite time plate facilitates setting, change and confirmation of the programmed relative operation of plural loads; and (3) Convenience is offered for use in a programmable timing connector with a clock.

Embodiment 6

In the composite device formed by coupling a plurality of timing devices with common rotators, there is the type capable of extending a time cycle.

Figure 10:
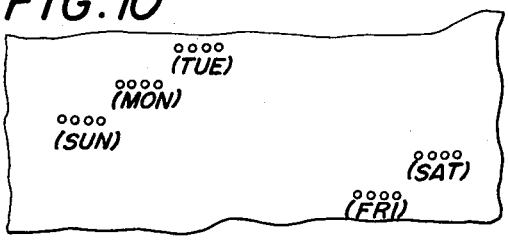
FIG. 10 is a partial plane view illustrating a slow aperture arrangement on the slow rotator of a composite timing connector having a one-week cycle.

In FIG. 1, if one of the two groups of slow apertures d00 and so forth provided symmetrically with respect to the axis is removed, the timing device obtained as the result is such that it operates every other day intermittently. Supposing now that this device is employed as #1 of FIG. 9 and the device having the removed group of slow apertures d00 and so forth is employed as #2, then the composite timing device consisting of #1 and #2 in combination comes to have a 48-hour cycle. Similarly, a composite timing device of 1-week cycle can be obtained by producing, according to FIG. 1, a unit timing device which uses one-seventh of the cylindrical surface as a time plate and is equipped with a slow rotator having seven slow apertures symmetrically positioned with respect to the axis, and combining seven of such unit timing devices by the method described above. FIG. 10 shows the development of the slow aperture arrangement on a slow rotator used in a composite timing device of 1-week cycle and 15-minute interval.

Embodiment 7

Figure 11A:
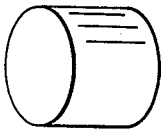
FIGS. 11 (*a*), 11 (*b*) and 11 (*c*) illustrate conversion of a cylindrical timing device into a plane-shaped device in a phase geometrical manner.
Figure 11B:
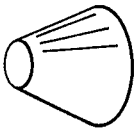
Figure 11C:
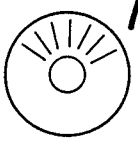

In the device of FIG. 1, all the timing plates and rotators are cylindrical. If these components are transformed in a phase geometrical manner equiphasically, as illustrated in FIG. 11 (*a*)-(*b*)-(*c*), then a plane sector-shaped time plate and a rotator group of corresponding shape are obtained. The device thus produced is also an exemplary mode of the present invention. As for the time elements in this plane timing device, coarse-division times are assigned to lattice points arranged in the circumferential direction, and fine-division times are assigned to those arranged in the radial direction.

Embodiment 8

The composite timing device of FIG. 12 has a disadvantage in that the area of the time plate is widened by multiple times equal to the number of combined unit devices. Therefore, in long-cycle and small-interval type is where the time plate of each unit device occupies a considerably large area, the problem of area becomes a great impediment to attainment of such combination.

Figure 14A:
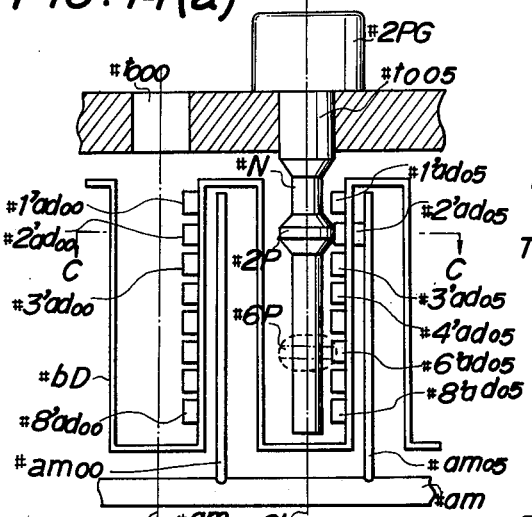
FIGS. 14 (*a*) and 14 (*b*) illustrate a timing connector equipped with layers of combined components, in which FIG. 14 (*a*) is a partially enlarged front sectional view of a principal portion, and FIG. 14 (*b*) is a plan sectional view taken along the line C—C of FIG. 14 (*a*), wherein CL denotes a circumferential lattice line and AL denotes an axial lattice line.
Figure 14B:
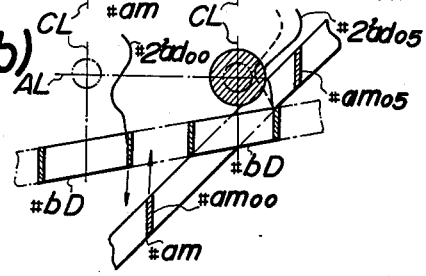

FIG. 14 illustrates a structure which settles such a problem by combining timing devices #1', #2' . . . #8' (corresponding to #1, #2 and so forth of FIG. 12) in layers in the direction of depth.

In FIG. 14 (*a*), #1'ad00, #1'ad05 and so forth are conductive slow brushes of timing device #1' originally, and #2'ad00 and so forth are slow brushes of #2'. A nonconductive slow rotator #bD is moved rotatively in the direction perpendicular to the drawing paper face, and consists of a bent plate piece which holds the slow brushes. Brushes #1'ad00, #1'ad05 and so forth are grouped electrically at #1ad (not shown) on #bd, while #2'ad00, #2'ad05 and so forth are grouped alike at #2ad (not shown), and #1ad, #2ad and so forth are led to the outside respectively by means of a slide contact or the like and are connected individually to external loads such as channel-selecting contact plates.

Those labeled as #am00, #am05 and so forth are conductive fast brushes in the shape of a plate piece, and are held by plate-shaped conductive fast rotator #am which moves rotatively in the direction perpendicular to the drawing paper face. The rotator #am is also led to the outside to constitute a part of the drive circuit.

As shown in the sectional plane view of FIG. 14(*b*) taken along the line C—C, the speeds and positions of the slow and fast brushes remain substantially unchanged as in FIG. 12, but are different merely in the point that they overlap each other and the direction of flexure and contact is axial instead of being radial.

Regarding the plug which is to be inserted in the selective presetting of time by placing it into a plug hole on the time plate of the composite device, there are a plurality of kinds including at least one kind for each unit timing device. The drawing depicts a plug #2PG for use in timing device #2'. This plug has a thick portion #2P on its protrusion #N at a position to press slow brushes #2ad'00, #2ad'05 and so forth. When the thick portion is located at a position #6P, the plug is for use in a timing device #6', and when it is located at both #2P and #6P, the plug is adapted for simultaneous drive of loads connected to #2' and #6'.

Although the device of FIG. 14 is not equipped with any very fast brush, when it is required to further enhance the time accuracy and to shorten the contact time length of the timing connection, configuration of the timing circuit may be modified by connecting, instead of the very fast brush, a switch of high durability, such as a reed switch driven by a magnet rotating at a high speed. The switch closes the circuit at 5-minute intervals synchronously with the fast brush, in series with terminal #am which is led to the outside.

In the case of an electronic tuner or the like, since there occurs no instance where a plurality of channels are selected at a single time, it is preferred to furnish eight kinds of plugs each having a single thick portion.

In addition to the foregoing embodiments, the present invention is capable of taking various modes.

Referring first to the passing speed of each aperture or brush, the function remains unchanged in the timing device of FIGS. 1 and 2 if the rotation speed of, for example, the fast rotator is increased to 1 revolution per hour + one-half revolution per 24 hours.

Figure 13:
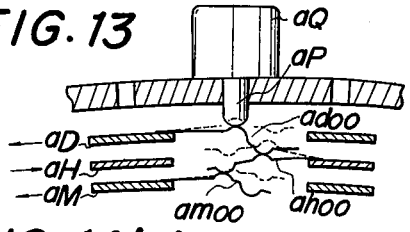
FIG. 13 is an enlarged partial view of another embodiment of brushes driven in different directions of rotation of the rotators.

When the size of time element (light transmitting hole, plug, etc.) and the width thereof in the direction of rotation of each aperture or brush are sufficiently small, further increase of the speed is possible. Moreover, reverse rotation at a speed of one-half revolution per 24 hours - 1 revolution per hour, is also permitted for the fast brush. In general, with regard to the number and positions of apertures and brushes (two symmetrical groups in FIG. 1) disposed on a rotator, the speed and direction of rotation thereof, the dimensions of light transmitting holes and plugs, and the width of apertures and brushes, considerably wide change of design is allowed without causing malfunction in the timing action. FIG. 13 plots the shape of simplified brushes in the instance where the rotational directions of the rotators are different from one another. The reference symbols correspond to those in FIG. 6. However, noting the time width required for passing through a lattice point, its standard period during which a slow (fast) brush passes through the inside of the lattice point is approximately less than the time interval of coarse (fine) division, but may be more than that in some cases.

Each of the embodiments mentioned above is a device equipped with a time plate where time points are arranged in the form of a lattice. In case the fine division of time is not so necessary, it is sufficient to use a timing device that is equipped with a time plate having, instead of a lattice arrangement consisting of plural rows, only a single row of time points arranged at equal intervals (as *t*000, *t*100 . . . *t*2300 of FIG. 2). The times assigned to the equal-interval points of a single row in the embodiment of FIGS. 1 and 2 are divided at one-hour interval which is not so fine. When it is desired to make the division finer such as 15-minute intervals in a 24-hour cycle, the purpose may be accomplished by increasing the number (or density) of apertures of one row by four times to set the rotation speeds of a slow rotator and a fast rotator to one-half revolution per 24 hours and 1/2 revolution per 24 hours + one-half revolution per 15 minutes. The same is applicable to the very fast brush. For attaining fine division of time in a single row, since the circumference is to be divided finely, it is necessary to narrow the "width" of connection or contact of each aperture or brush in the direction of rotation and to ensure high-accuracy angular regulation so that no looseness occurs during rotation.

As for the exterior shape of the timing device, any rotative curved surfaces are adoptable including conical, barrel-like and oval shapes in addition to cylindrical and plane ones, so that convenience is offered as viewed from creation of decorative design. Although the individual rotation speeds in this device may seem to be complicated and difficult for practical attainment, it is easy to obtain from a synchronous motor the very fast, fast and slow rotations sequentially in this order through speed reduction by means of gears as effected generally.

Embodiment 9

In the timing devices of the foregoing embodiment, the same function is maintained if the "whole speed" is changed while the relative positions and speeds of the time plate, slow rotator, fast rotator and very fast rotator are left unchanged. This embodiment is formed by changing the respective speeds of Embodiments 1 through 8.

The type where the whole speed is changed in the mode of stationary slow rotator D has many advantages, which are listed below.

[1] Further simplified structure:

Referring to FIGS. 1 and 2, for example, the rotation speeds of the individual components after change are as follows:

Time plate T . . . minus one-half revolution per 24 hours

Slow rotator D . . . still (stationary)

Fast rotator H . . . one-half revolution per hour

Very fast rotator M . . . one-half revolution per 5 minutes. The above ratio of rotation is adopted commonly in ordinary clock means, and a row of gears used therein are easily available and can be carried into effect with facility.

[2] Viewing ease and operational convenience of the device:

When the slow apertures or brushes to be fixed are disposed in front of a viewer, the time plate T rotated at a speed of minus 1 revolution per 24 hours, keeps displaying the lattice point and the time element of the present time to its face, so that the timing indication and connection are accompanied with expectation and satisfaction of the viewer. In this embodiment, the time plate T of FIGS. 1 and 2 has another group of 1-day time lattice points arranged on the remaining half surface, one of each pair of fast and very fast apertures is removed or closed, and two days are divided at 5-minute intervals. Furthermore, instantaneous change or confirmation of the program is facilitated to enhance familiarity and reliance to the device.

[3] Simplification of optical timing connector:

It becomes possible to adopt the means of employing, instead of the optical fibers and photodiodes of FIG. 3, photodiodes PHD00 and so forth fixedly at positions corresponding to slow apertures d00 and so forth, as illustrated in FIG. 1. However, since the time plate T of FIGS. 1 and 2 is inconvenient, it is to be modified to the type that sets time elements by changing lattice points from a light untransmissible state to a transmissible state. The light receiving photodiodes PHD00 and so forth may be replaced with a single photodiode PHD and plural optical fibers OP00 and so forth connected to PHD, as shown by the dotted lines. When the light receiving part is sufficiently small, the slow apertures can be omitted or eliminated and consequently the slow rotator as well. This method can also be carried into effect in any device preceding Embodiment 9, but the greatest effects are achieved particularly in Embodiment 9.

[4] Simplification of mechanical timing connector:

Since the conductive slow brushes are fixed, no slide contact means is required to draw out the leadwires. Using the structure of FIG. 6, for example, a simplified timing connector can be obtained by rendering the plug nonconductive, forming the conductive slow and fast brushes into the shape of FIG. 8, and further forming the very fast brush into the shape of FIG. 7 or into a mere wire.

Embodiment 10

Figure 15:
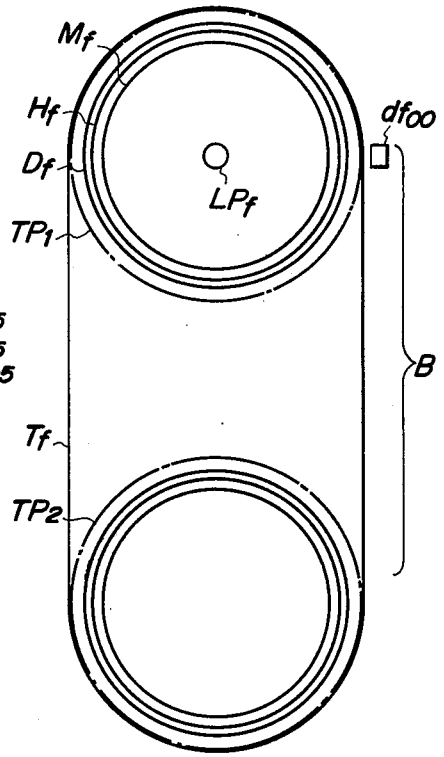
FIG. 15 is a typical sectional side view of a timing connector having a belt-shaped time plate.

The above-mentioned cylindrical time plate T brings about various advantages when composed of a transparent or nontransparent belt-shaped rotator in the case where it is to moved due to adoption of the method of Embodiment 9. FIG. 15 is a cross-sectional view of an optical timing connector of this type, in which light untransmissible lattice points of two days are arranged on the entire surface of a nontransparent belt-shaped time plate Tf similar to T of FIG. 2 (with the correction described in [2]). The belt is engaged with an upper pulley TP1 and a lower pulley TP2, and is driven by TP1 which rotates at a speed of minus 1 revolution per day, so that the belt makes (minus 1 revolution per day). Df is stationary; Hf and Mf are rotators rotating at speeds of (1 revolution per hour and 1 revolution per 5 minutes respectively, and having a pair of fast and very fast aperture groups respectively; and LPf is a lamp similar to LP of FIGS. 1 and 2. Light-receiving photodiodes df00 and so forth are located outside the slow apertures. (When the photodiodes are sufficiently small, Df can be omitted.)

It is apparent that when light transmitting holes (time elements) are provided selectively at the lattice points on the belt Tf, optical timing connection is achieved in the light receiving photodiodes.

It may be needless to explain that a mechanical timing connector is obtainable by arranging plugs and brushes instead of light receiving members and light transmitting holes.

A belt-shaped time plate is usable in place of the stationary time plate in any device preceding Embodiment 9 (in this instance, D, H and M are also to be formed into belts), but it is effective particularly in the case of Embodiment 9. The merits of such a belt-shaped time plate are as follows. (1) When the flat portion B of the belt is placed in front of a viewer, preparation and confirmation of a program are facilitated for a long period of time; (2) Increasing the belt length extends the time cycle of the device; and (3) The device dimensions can be reduced, particularly in the depth.

Furthermore, employment of a belt may also be applied to other rotators aside from the time plate so as to achieve effects of miniaturization.

In the timing device, the construction of its time plate and time elements determines the cost and operational convenience. Therefore, some examples of advantageous time plate and elements usable in the present invention will be described hereinafter.

(EXAMPLE 1)

Figure 16:
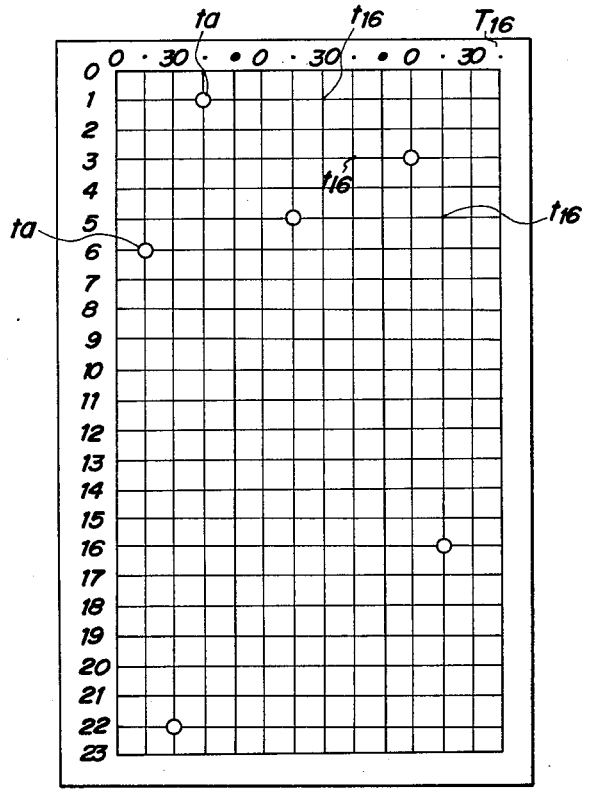
FIG. 16 shows an optical storage type program sheet.

In the timing connector of the invention, the frequent usage required is such that it selects a program as desired out of multiple ready-made programs stored. When the program is complicated, it is troublesome to change the preset time elements one by one. FIG. 16 illustrates a black, flexible sheet T16 where lattice points t16 are printed, and this sheet is applied to such usage in the manner that, after programs are prepared by forming light-transmitting holes ta, a desired one is attached to a light-transmissible time plate.

(EXAMPLE 2)

Figure 17:
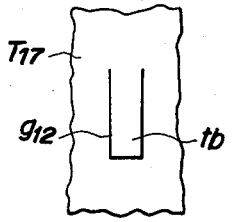
FIGS. 17 (*a*), 17 (*b*), and 17 (*c*) show a portion of a mechanical or optical program sheet, in which FIG. 17 (*a*) is plane view, FIG. 17 (*b*) is a sectional view, and FIG. 17 (*c*) is a sectional view illustrating the state where a time element is set.
Figure 17:
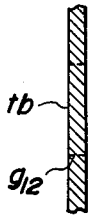
Figure 17:
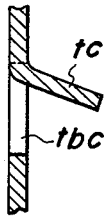
Figure 18A:
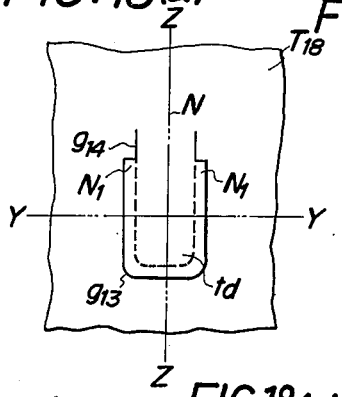
FIGS. 18 (*a*) through 18 (*f*) show a time element requiring no attachment or detachment, in which FIG. 18 (*a*) is a plane view, FIG. 18 (*b*) and FIG. 18 (*c*) are sectional views, FIG. 18 (*d*) and FIG. 18 (*e*) are sectional views illustrating the state where the time element is set, and FIG. 18 (*f*) is a side view of the tip of a hook needle for operating the time element.
Figure 18C:
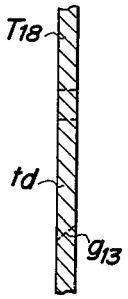
Figure 18E:
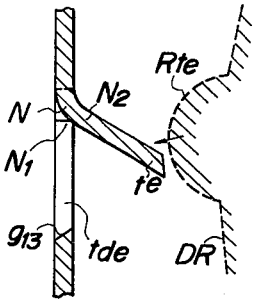
Figure 18B:
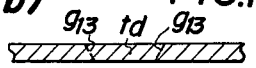
Figure 18D:
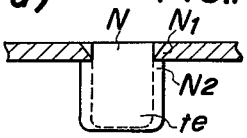
Figure 18F:
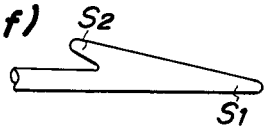
Figure 19A:
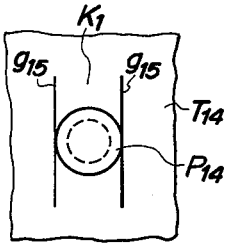
FIGS. 19 (*a*) through 19 (*c*) show a time element similar to FIG. 18, in which FIGS. 19 (*a*) and 19 (*b*) are plane views, FIG. 19 (*c*) is a sectional view, and FIG. 19 (*d*) is a sectional view illustrating the state where the time element is set.
Figure 19B:
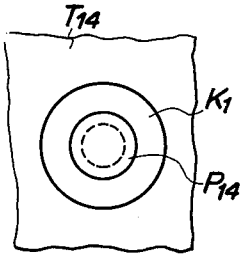
Figure 19D:
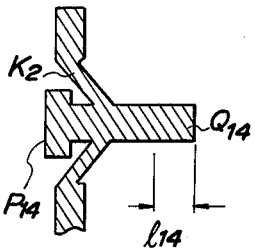
Figure 19C:
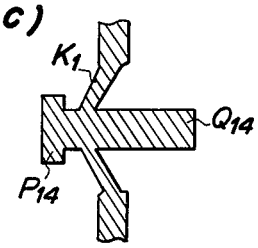

In a mechanical timing connector, this storage type program can be prepared by first producing a sheet T17 from a relatively hard aluminum plate or the like as shown in FIG. 17, then forming a notch 12 at each lattice point, subsequently bending a tongue tb to make tc as shown in FIG. 17(c), and enabling tc to function in the same way as protrusion aP of FIG. 6. (In this example, the obtained after formation of tc is usable as a light transmitting hole).

Example 3)

In the timing connector, it is generally troublesome to open or close the light transmitting holes or to attach or detach the plugs and the plugs detached are liable to be lost. This example solves such a problem with a structure where a tongue td consisting of a vertical notch *g*14 and an olique notch *g*13 is provided at each lattice point of a flexible time plate T18 shown in FIG. 18 (18*a*, 18*b* and 18*c*). When the tongue td is pressed in with a finger or tip S1 of a hook needle of FIG. 18(*f*), a base N of tongue td is bent in the form of te shown in FIGS. 18(*d*), and 18(*e*), so that bases N1 and N2 of the opposite oblique notch come to butt against each other, thereby causing the tongue te to stay in the state of downward protrusion. This tongue te functions in the same manner as the protrusion aP of FIG. 6, and tde obtained after protrusion of the tongue is usable as a light transmitting hole. The tongue is returned to the former position td by inserting the hook needle of 18(*f*) deep into the hole tde and drawing out the tongue by a hook S2.

In some applications, automatic resetting of the tongue is required after use. This can be attained easily in Embodiment 9 by the provision of a drum DR which has, as plotted by dotted lines in FIG. 18(*e*), multiple protrusions Rte capable of protruding into holes *tde*. The protrusions Rte are so disposed as to protrude at all lattice points. And while the drum DR is rotated synchronously with the time plate, the tongue is pressed back with the protrusion as shown by the arrow. Convenience is offered by the provision of a mechanism which separates the drum DR from the time plate as required so as to release such automatic resetting operation.

(EXAMPLE 4)

An automatically resettable plug (substitute) needing no attachment or detachment can be composed as illustrated in FIG. 19, in which 19(*a*) and 19(*b*) are plane views of a lattice point on a time plate T14 of a flexible material, and g15 is a notch or groove extending to the reverse side of the time plate; and 19(*c*) is a sectional side view common to both 19(*a*) and 19(*b*). When a head P14 is pressed with a finger, a thin portion K1 is inverted downward and shifted to the state of K2 shown in 19(*d*), so that a protrusion Q14 protrudes downward by a length *l*14 to set a mechanical time element. This element is reset to the state of 19(*c*) by drawing out the head P14 with fingers.

Discrimination between the set state and the reset state of a time element is facilitated by coloring the portion K1 (or the tongue in the preceding example) with paint.

The adoptability of such convenient time elements (Examples 1 through 4) is one of the eminent features of the present invention, and it is greatly effective in providing a useful device at a lower cost.

The advantages of the timing device according to the present invention are summarized as follows.

(1) Timing indication is unique and excellent in design.

(2) Timing connection is simple and nearly trouble-free.

In the device of FIG. 6, for example, connection is effected only at the position of a preset time element and at the given time assigned thereto. At any other position or time, brushes are moved without mutual contact so that a long service life is ensured.

(3) Brief assembly and low cost are attained due to minimum component parts and no necessity of wiring.

(4) The composite device of FIG. 9, for example, is adapted especially for programmed automatic channel-selecting reception of radio or television. Since the appearance of the time plate resembles the broadcast program column of daily newspaper, convenience is offered for setting, change and confirmation of the channel-selecting program.

(5) Time accuracy can be enhanced by the addition of very fast brushes and the like.

(6) Combination of unit devices permits programmed drive of multiple loads and extension of time cycle.

Thus, the present invention proves to be industrially useful.

What is claimed is:

1. An apparatus comprising one or more timing devices, each timing device including a rotatable time plate having thereon time-representing points where time-indicating logical connection elements are to be provided, said points being arranged at least in one row at equal intervals in the direction of rotation; each timing device further including at least two rotators capable of rotating at different speeds in the vicinity of said time plate and individually holding at least one time-regulating logical connection element: wherein at least one of said time plate and said rotators of each said timing devices is used in common when a plurality of said timing devices are provided and wherein the time-representing point and the time-regulating logical connection element in each of said timing devices are in such positional relation that the time-regulating logical connection element comes into alignment with the time-representing point only at a given time assigned thereto; and the time-indicating logical connection element provided at said point and the time-regulating logical connection element of each rotator in each of said timing devices cooperate to effect timing connection through a logical product obtained at the given time assigned to said point; and either the time plate or the slowest rotator is installed to be stationary.

2. The apparatus as defined in claim 1, wherein said time-indicating logical connection element consists of a plug; said time-regulating logical connection element consists of a brush; and electrical connection based on a logical product is effected between the electrical contacts which are provided on at least one of said plug and said brush.

3. The apparatus as defined in claim 1, wherein said time-indicating logical connection element consists of a light path extending from a light source to a light sensor opposed thereto through the rotators; said time-regulating logical connection element consists of a light transmitting hole formed on each rotator; and timing connection based on a logical product is effected in said light sensor.

4. The apparatus as defined in claim 1, wherein said time-indicating logical connection element consists of a light transmitting hole; said time-regulating logical connection element provided on the slowest rotator consists of a light path extending from a light source to a light sensor opposed thereto through the other rotator and the time plate; the time-regulating logical connection element provided on the other rotator consists of a light transmitting hole; and timing connection based on a logical product is effected in said light sensor.

5. The apparatus as defined in claim 2, wherein said time-indicating logical connection element is formed through partial deformation thereof at a time-representing point of the time plate.

6. The apparatus as defined in claim 4, wherein said time-indicating logical connection element is formed through partial deformation thereof at a time-representing point of the time plate.

7. The apparatus as defined in claim 2, which further comprises a detachable sheet having time-repesenting points where the time-indicating logical connection elements are to be provided.

8. The apparatus as defined in claim 4 which further comprises a detachable sheet having time-representing points where the time-indicating logical connection elements are to be provided.

9. The apparatus as defined in claim 5 which further comprises a detachable sheet having time-representing points where the time-indicating logical connection elements are to be provided.

10. The apparatus as defined in claim 6 which further comprises a detachable sheet having time-representing points where the time-indicating logical connection elements are to be provided.

* * * * *